United States Patent [19]

Gulliksen

[11] 4,316,241

[45] Feb. 16, 1982

[54] METHOD AND APPARATUS FOR CONTROLLING REFLECTED ENERGY INCLUDING DUAL LIGHT TRANSMITTING MEANS FOR PRODUCING A SPOT TO FLOOD CONFIGURATION

[75] Inventor: John E. Gulliksen, Shrewsbury, Mass.

[73] Assignee: Koehler Manufacturing Company, Marlborough, Mass.

[21] Appl. No.: 103,097

[22] Filed: Dec. 13, 1979

[51] Int. Cl.[3] ..... F21V 13/04; F21L 23/00; F21V 17/02

[52] U.S. Cl. ..... 362/268; 362/164; 362/281; 362/283; 362/325; 362/360; 362/361

[58] Field of Search ..... 362/268, 281, 283, 325, 362/360, 361, 164

[56] References Cited

U.S. PATENT DOCUMENTS

| | | | |
|---|---|---|---|
| 2,076,240 | 4/1937 | Levy | 362/281 |
| 2,236,845 | 4/1941 | Curry | 362/281 |
| 2,712,060 | 6/1955 | Johnson | 362/419 |
| 2,848,601 | 8/1958 | Beach | 362/331 |
| 2,903,570 | 8/1959 | Worden | 362/268 |
| 4,023,031 | 5/1977 | Storey | 362/281 |
| 4,085,932 | 4/1978 | Hamano | 362/281 |
| 4,233,651 | 11/1980 | Fabbri | 362/268 |

*Primary Examiner*—Benjamin R. Padgett
*Assistant Examiner*—Irwin Gluck
*Attorney, Agent, or Firm*—Hamilton, Brook, Smith & Reynolds

[57] ABSTRACT

Apparatus for controlling reflected radiant energy to progressively vary distribution of the reflected radiant energy between spot and flood configurations comprises a housing body having a reflector surface, a lamp mounted in the housing body at the focal point of the reflector surface, and a dual light transmitting unit supported at an outer side of the housing body. The dual light transmitting unit includes a light transmitting disk component of circular shape fixed in abutting relation to the housing body, and a light transmitting disk cover component mounted for rotative movement about the central axis of the housing body and against the light transmitting disk.

The light transmitting disk component is of generally circular shape and has an inner portion removed to form a substantially semi-circular opening. A remaining inner portion of the disk is formed with truncated arcuate mating portions which are light refracting and which present substantially V-shaped surfaces whose crests occur in concentrically spaced apart relationship to one another. The term "truncated" as herein employed is intended to define arcuate mating portions of limited annular extent.

The rotatably mounted disk cover component is cylindrical in shape and has an end wall formed at an inner portion thereof with truncated arcuate mating portions also of light refracting character. These mating portions have substantially V-shaped surfaces which are complementary to the V-shaped surfaces of the disk component. A remaining inner portion of the end wall of the disk cover component is planar and of substantially semi-circular shape similar to the semi-circular opening in the disk component. The two sets of V-shaped surfaces are slidably engagable with one another.

In a preferred embodiment, the openings in the light transmitting disk component and the planar portion of the end wall of the disk cover component are slightly less in circumferential extent than 180° to insure that some part of the truncated arcuate mating portions are always in a position of engagement, and thus loss of register between the mating portions of the two components is avoided.

8 Claims, 20 Drawing Figures

Fig. 1
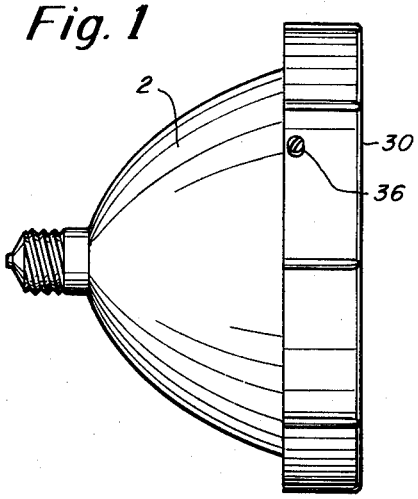
Fig. 2
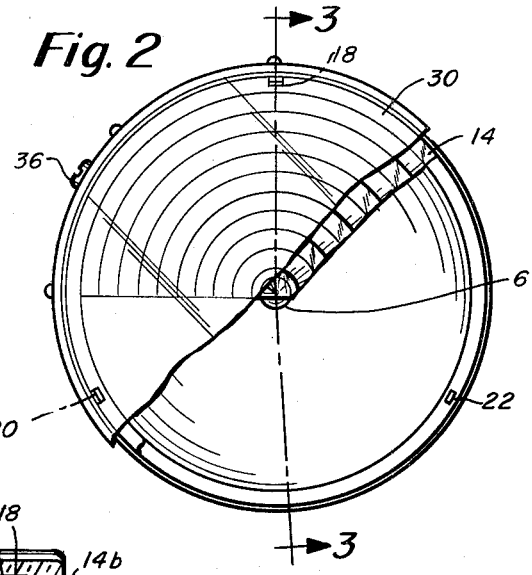
Fig. 3
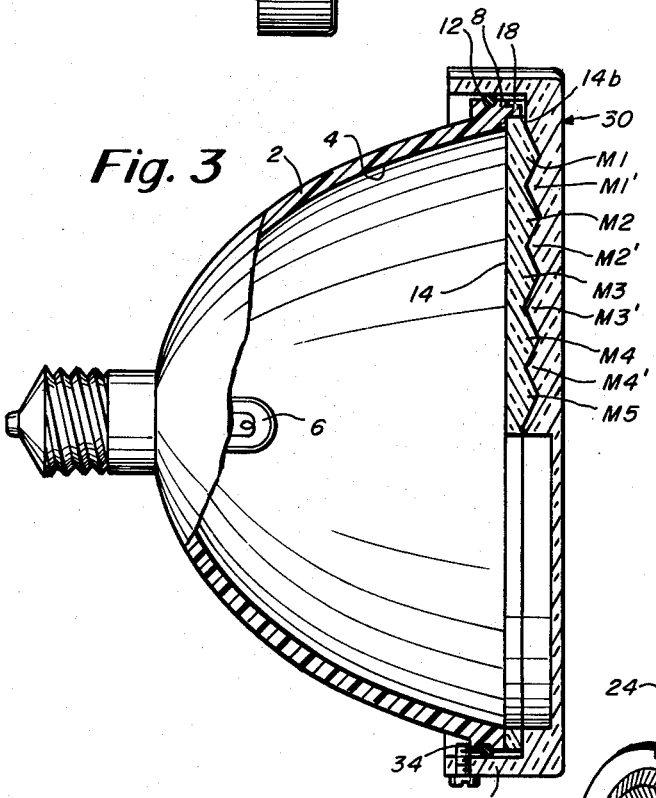
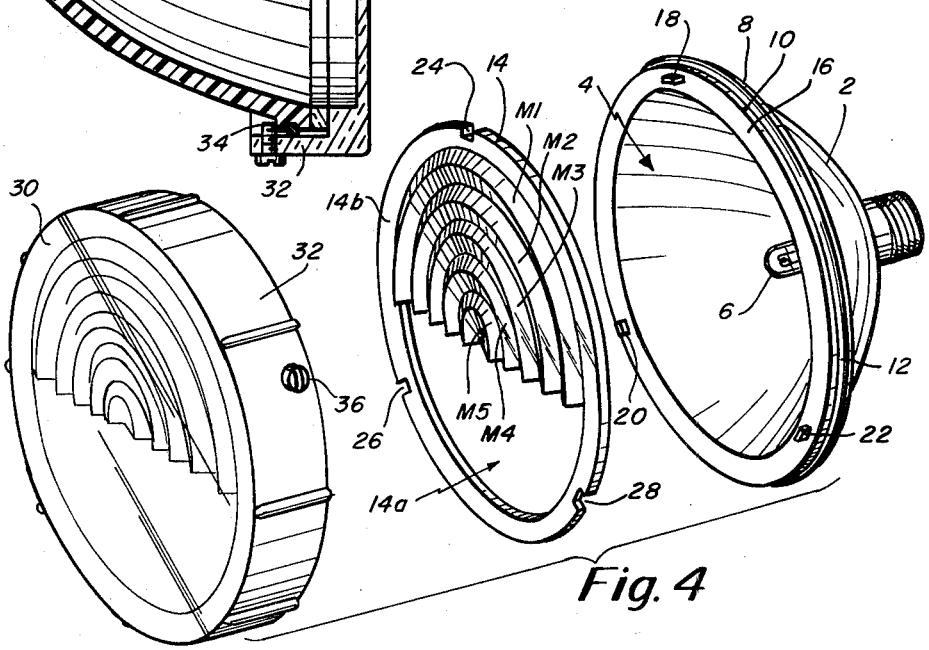
Fig. 4

METHOD AND APPARATUS FOR CONTROLLING REFLECTED ENERGY INCLUDING DUAL LIGHT TRANSMITTING MEANS FOR PRODUCING A SPOT TO FLOOD CONFIGURATION

BACKGROUND OF THE INVENTION

In the art devices with dual light transmitting members for producing spot to flood configurations of reflected radiant energy are well known. Devices of this general nature have, for example, been disclosed in U.S. Pat. Nos. 1,862,276, 2,712,060, 1,768,613, 1,875,607 and 2,155,752. In Pat. No. 2,712,060 there is disclosed a device designed for use on an aircraft body and arranged to provide for producing remote control of a spot to flood configuration of reflected rays of light. In this device a pair of Fresnel type light transmitting members are mounted in front of a lamp and reflector body with one of the Fresnel type light transmitting members being rotatable with respect to the other.

Each of the light transmitting members of this patent contains Fresnel lens portions extending across the light transmitting members in parallel relation to one another. When the Fresnel lens portions are perfectly mated with one another, a spot configuration is produced. To produce a flood configuration, one of the light transmitting members must be rotated with respect to the other and, before this can be done, one light transmitting member must be axially displaced with respect to the other. This is objectionable since it produces an immediate discontinuity in the adjustment from spot to flood. In addition, the axial displacements of light transmitting members will make the device quite susceptible to accumulation of foreign matter between the light transmitting members, which will interfere with proper mating of the lens parts when adjusted for a spot configuration.

A second prior art disclosure which also describes a dual light transmitting system, in which one light transmitting member is rotatable with respect to another, is set forth in U.S. Pat. No. 2,848,601. In this device the light transmitting members are constructed with sectors having refracting portions by means of which a variance between spot and flood configurations may be realized. However, in this device, alternate sectors are constructed with annuloid lens portions, while the intervening refracting sectors are constructed with lens portions which extend radially outwardly from the center. With this arrangement the lens portions must again be perfectly mated to produce satisfactory spot configuration.

The need for axial displacement of one light transmitting member before rotation may be carried out is present in this device as well, and thus the same objections as those already noted with respect to U.S. Pat. No. 2,712,060 are present In addition, neither of these prior art devices can provide for configurations of light distribution between the extremes of spot and flood in which illumination of areas peripheral to the spot may be provided in a predetermined and controlled configuration.

SUMMARIZATION OF THE INVENTION

The present invention relates to an apparatus for controlling reflected radiant energy to progressively vary distribution of the reflected radiant energy between spot and flood configurations. The dual light transmitting means of the invention, while not limited thereto, is especially useful in miners' cap lamps. These cap lamps, as worn by miners in underground mining operations, are required to have highly specialized performance characteristics to meet with a range of conditions which may be encountered by a miner in the usual workday in a mine.

It is an object of the invention, therefore, to improve spot to flood producing devices for controlling reflected radiant energy.

Another object is to provide in a dual light transmitting means light reflecting portions which are slidably engagable with one another in mating relationship and which are of a high degree of efficiency suitable for meeting miners' cap lamp requirements.

It is a further object of the invention to devise a dual light transmitting unit which is of simplified design enabling the unit to be mounted on various classes of existing cap lamps now used in the trade.

Another object is to provide for better control of continuous adjustment for reflected radiant energy between spot and flood configurations and especially to provide for illuminating areas peripheral to the spot in a predetermined and controlled configuration.

Another object is to provide dual light transmitting means which are resistant to accumulation of foreign matter and which are of a self-cleaning nature.

It has been found that the foregoing objectives may be realized by means of a dual light transmitting unit which is characterized by truncated light refracting portions having V-shaped surfaces which mate with one another and whose angles of inclination may be so chosen that a highly efficient transmission of reflected radiant energy may be achieved in a spot configuration and, when desired, a desirable flood configuration may be instantly produced.

The mating V-shaped refracting surfaces of the disk component and the disk cover component and cleaning edges thereof are not only complementary to one another but have angles of inclination which are chosen to most effectively provide for a spot configuration of reflected radiant energy when the V-shaped surfaces are located in a fully mated relationship to one another and which can still provide an adequate degree of flood configuration when moved out of mating relationship with one another. A flood configuration of reflected light rays is produced when the V-shaped surfaces of the disk cover component are moved substantially out of mating engagement with the V-shaped surfaces of the disk component. A very desirable control of progressively increasing flooding is readily achieved by varying the extent of mated relationship of the V-shaped surfaces of each component.

BRIEF DESCRIPTION OF THE DRAWINGS

FIG. 1 is a side elevational view of the luminaire apparatus of the invention.

FIG. 2 is a front elevation of the apparatus partly broken away.

FIG. 3 is a cross section taken on the line 3—3 of FIG. 2.

FIG. 4 is an exploded view showing in perspective the components of the apparatus removed from a housing member.

DETAILED DESCRIPTION OF THE INVENTION

Figure 5:
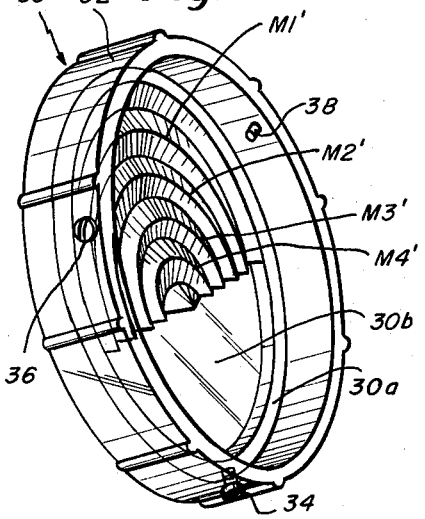
FIG. 5 is a perspective view of an inner side of the light transmitting disk cover component shown in FIG. 4.
Figure 6:
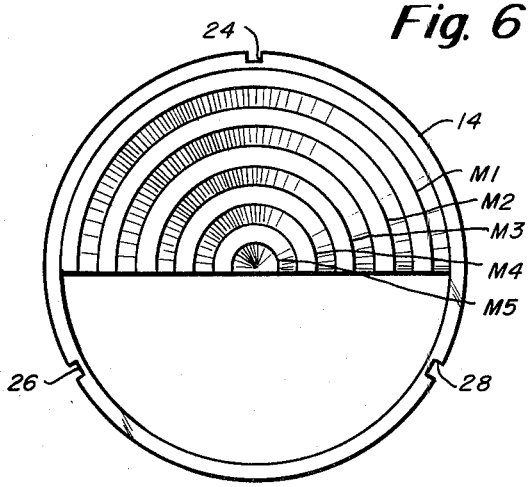
FIG. 6 is an elevational view of the light transmitting disk component of the invention.

The apparatus of the invention in general comprises a housing body having a reflector surface, a light source mounted at the focal point of the reflector surface, and a dual light transmitting unit supported on the housing. The dual light transmitting unit includes a light transmitting disk component which is arranged in fixed abutting relation against the housing body and a second disk cover component which is rotatably mounted around the housing and against the fixed disk component. This apparatus is intended to be suitable for use on various types of luminaire equipment.

Considering these parts in further detail, numeral 2 denotes a housing body which may, for example, be of the screw base construction illustrated having a lamp 6 mounted therein. The inner side of the housing body is formed with a surface 4 for reflecting radiant energy and this surface may, in a preferred embodiment, be of parabaloidal form. At the outer circumference of the housing 2 there is provided a circular rim portion 8 in which is located a groove 10 and a resilient sealing ring 12.

In accordance with the invention, a dual light transmitting unit is mounted around the outer rim portion 8 of the housing 2. In this dual light transmitting unit is a light transmitting disk component denoted by the numeral 14. The light transmitting disk component is of circular shape and is located against a flat surface 16 of the rim portion 8. Extending outwardly from this flat surface 16 are lug portions as 18, 20 and 22 arranged to fit into slots as 24, 26 and 28 formed in the circular disk 14. This arrangement of parts provides for maintaining the disk 14 in a fixed position against the housing as illustrated in FIGS. 1–2 inclusive.

In FIG. 4 the light transmitting components are shown removed from the housing and in separated relationship to one another. As may be observed from an inspection of FIG. 4, the disk component 14 has an inner portion removed to form a substantially semi-circular opening **14*a* of an arcuate extent slightly less than 180°. A remaining inner portion of disk 14 is formed with truncated arcuate mating portions as M1, M2, M3, M4 and M5** which extend for an arcuate distance slightly greater than 180° and which present substantially V-shaped surfaces whose crests occur in concentrically spaced apart relationship to one another. It is pointed out that these arcuate mating portions with their substantially V-shaped surfaces are formed of a light transmitting material such as glass, plastic or the like, and that these portions constitute light refracting elements.

The second component of the dual light transmitting unit comprises a light transmitting disk cover component which is denoted by the arrow 30. The disk cover 30 consists of a cylindrically shaped member having an outer diameter slightly greater than that of the housing 2 so that a flange portion 32 of the cover may sealably engage around the sealing ring 12. Adjustable screw members 34, 36 and 38 extend through openings in this cylindrical flange portion 32 into engagement with a rear surface of the rim 8 of the housing to provide for the disk cover component 30 being secured for rotative movement around the housing. A shoulder portion **30*a* (FIG. 5) of disk cover 30 is maintained in abutting relationship against an outer circular edge 14*b* of the light transmitting disk 14. In FIG. 3 the screw member 34** is illustrated in the holding position described.

The rotatably mounted disk cover 30 has an inner light transmitting planar portion similar in shape to the substantially semi-circular opening **14*a* of the disk component. A remaining inner portion of the disk cover component is formed with truncated arcuate mating parts as M1', M2', M3' and M4'. These parts have substantially V-shaped surfaces which are complementary to the V-shaped surfaces of the disk component and which constitute a second set of light refracting portions. The truncated arcuate mating parts M1', M2', M3' and M4' have end walls as 103 (FIG. 5A) lying in a common plane which is parallel with the central axis of the disk cover. These truncated end walls are defined by cleaning edges as 105 which are employed as noted below. By means of the arrangement described, the two sets of V-shaped surfaces may be moved into and out of mating engagement with one another by rotation of the disk component with the end wall edges as 105 bearing against the V-shaped surfaces of the disk component 14**.

Figure 5A:
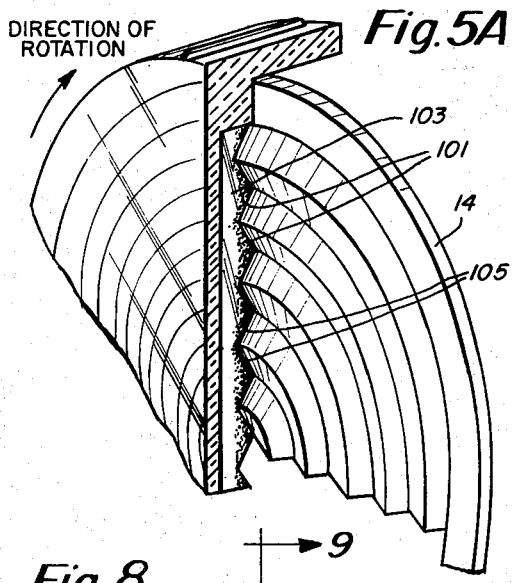
FIG. 5A is a perspective view partially cut away to show end portions of the disk cover component and cleaning edges thereof and further illustrating a self-cleaning action provided by rotation of the disk cover component.
Figure 7:
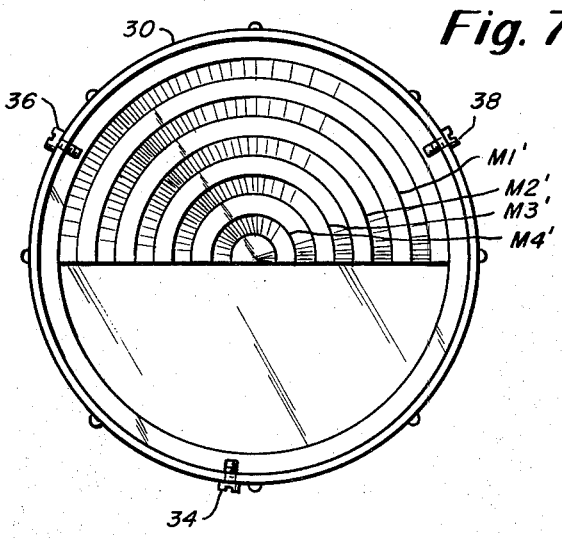
FIG. 7 is an elevational view of the disk component and disk cover component secured together.

Since the arcuate refracting portions as M1, M2, M3, M4 and M5 must mate with refracting portions M1', M2', M3' and M4' to provide an optimum spot configuration, and since foreign matter introduced between the disk 14 and cover 30 will adversely affect this mating as well as cause a decrease in the transmissivity of the two components, it is desirable to insure that foreign matter 101 (FIG. 5A) does not accumulate between the mating parts. FIG. 5A illustrates the self-cleaning action provided when disk cover 30 is rotated. Foreign matter 101 is scraped or pushed away by edges as 105 of the end walls 103 of the portions M1'–M4'. As foreign matter is scraped away, further rotation of the disk cover component will cause the foreign matter to fall into the housing body. In addition, repeated rotation of disk cover 30 will gradually lap the V-shaped surfaces M1–M5 of disk cover 14 against mating surfaces M1'–M4' of member 30, thus tending to produce improved mating relationship with use.

Figure 8:
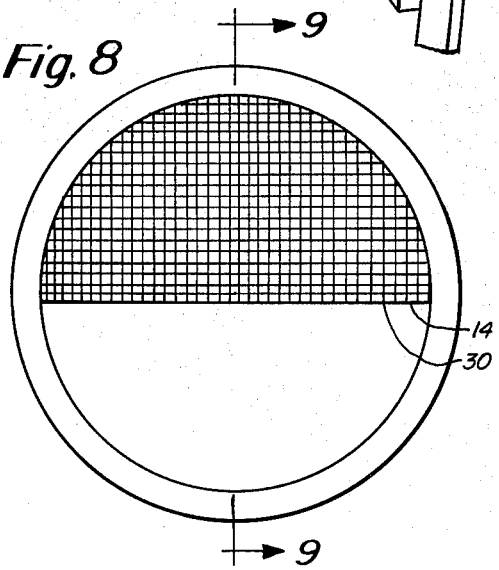
FIG. 8 is a diagrammatic view illustrating the apparatus with the disk cover and disk in a position to provide for a spot configuration of reflected radiant energy from a bulb member.
Figure 9:
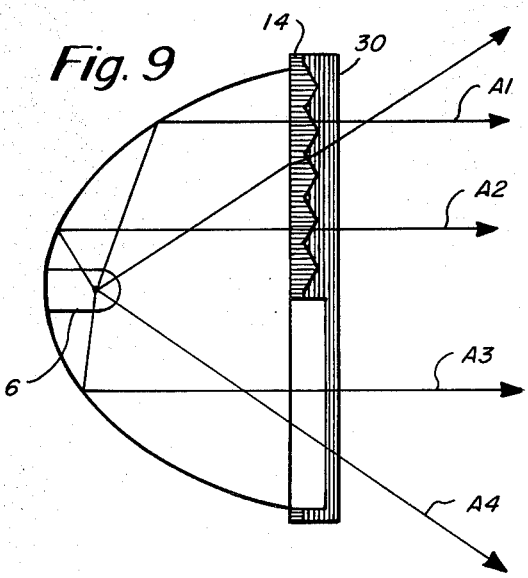
FIG. 9 is a cross section taken on the line 9—9 of FIG. 8 and further illustrating by arrows a spot configuration of reflected radiant energy.

It has been determined that, provided that the V-shaped surfaces of both the disk component and the disk cover component are fully mated, energy reflected from surface 4 may be transmitted substantially without change in direction through both the disk component and the disk cover component. There may thus be produced a spot configuration of reflected radiant energy. In FIG. 8, the disk 14 and cover 30 are illustrated in mating relationship with horizontal corss hatching indicating refracting portions of member 14 and vertical cross hatching indicating refracting portions of member 30. In FIG. 9, it will be noted that the disk and cover components are shown in fully mated position for a spot configuration and arrows A1, A2 and A3 represent diagrammatically reflected light rays passing through the disk and the cover components substantially unchanged in direction.

It is recognized that at any interface between two dissimilar members instant light rays will be bent into two distinct components; one refracted, the other reflected. To insure maximum efficiency of the device of the invention, angles of inclination of the V-shaped portions must be correctly chosen with reference to the occurrence of reflecting components in the device.

Figure 9A:
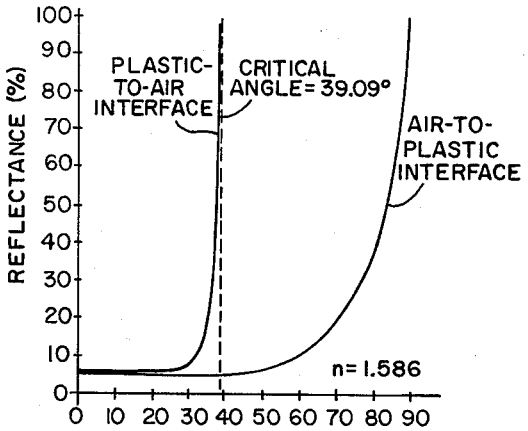
FIG. 9A is a diagrammatic view in which reflectance is plotted against angles of incidence of incident light.

FIG. 9A illustrates the percent reflectance as a function of the angles of inclination for interfaces between air and plastic and between plastic and air. The plastic used for this example is polycarbonate, having an index of refraction equal to 1.586. Values are deduced from simultaneous solution of the Fresnel equations and the Snell's Law equation.

Figure 9B:
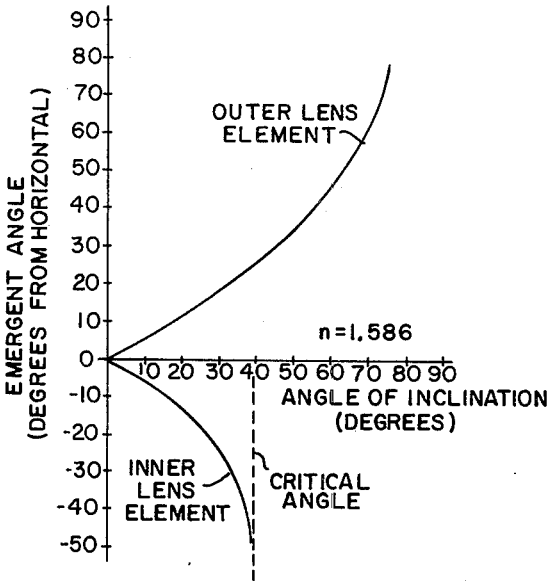
FIG. 9B is another diagrammatic view in which emergent angles of refracted light are plotted against angles of inclination.

From an inspection of FIG. 9A it can be seen that the angle of incidence should not exceed 30 percent from the normal to provide maximum transmissivity. Angles of incidence should, however, be suitable for providing an adequate flood effect. The divergence of the refracted rays can be calculated by solution of the equation for Snell's Law, $n_1 \sin \phi_1 = n_2 \sin \phi_2$. The relationship between angles of incidence and the emergent angles of refracted light rays is illustrated in FIG. 9B for the two components of the invention. From examination of this figure, it is apparent that the angle of inclination should be as great as possible consistent with minimal losses due to reflectance.

Figure 9C:
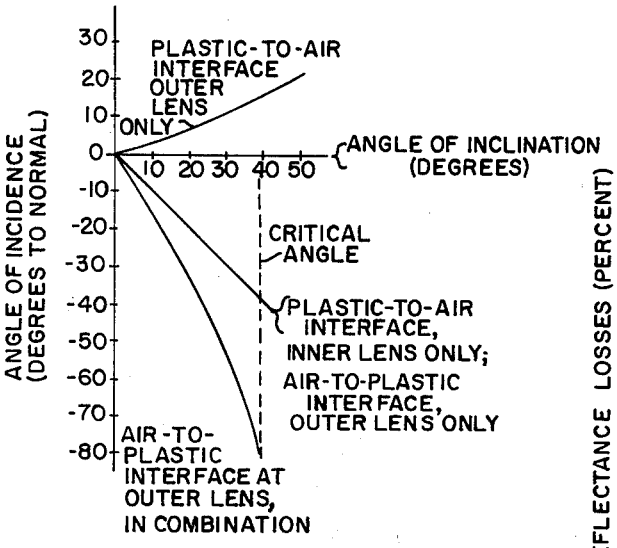
FIG. 9C is another diagrammatic view in which angles of incidence of incident light are plotted against angles of inclination for various portions of the components of the invention.

FIG. 9C illustrates the relationship between angles of incidence and angles of inclination at the various interfaces between air and the surfaces of the light transmitting members of the invention. These curves are deduced from a similar solution of the Snell's Law equation for the various interfaces.

Figure 9D:
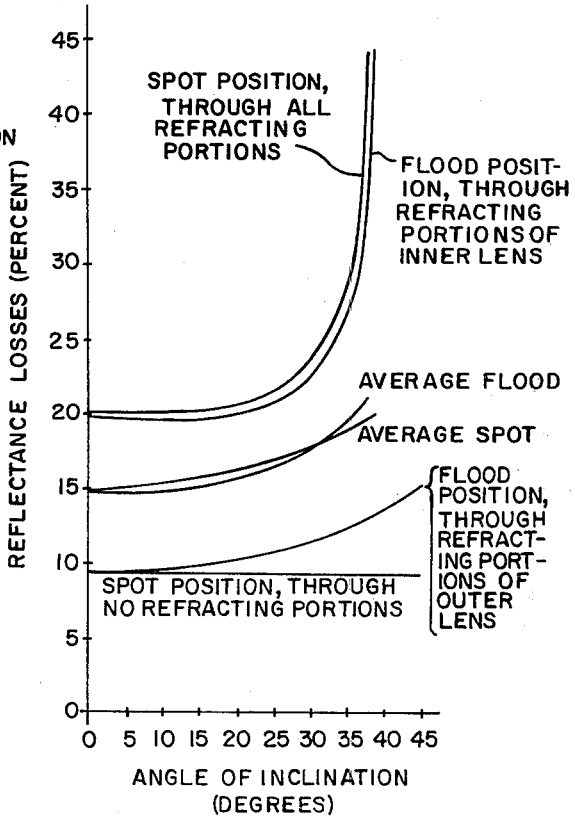
FIG. 9D is another diagrammatic view in which losses due to reflectance are plotted against angles of inclination for various components of the invention.

A combination of the curves of FIGS. 9A and 9C, bearing in mind that losses due to reflectance are multiplicative in nature, will produce the similarity of curves shown in FIG. 9D. Here the losses due to reflectance at each of the interfaces are plotted and summated for each component light transmitting member of the invention. Examination of the "average spot" and "average flood" curves shows that reflectance losses will be relatively low for angles of inclination which do not exceed 30° from a plane normal to the central axis of the luminaire apparatus.

Therefore, practically speaking, optimum angles of inclination will be in a range of from 20° to 30° from a plane normal to the central axis of the luminaire apparatus.

Optimum angles of inclination may vary slightly with materials having an index of refraction differing from that of polycarbonate being employed for the light transmitting members; optimum angles may be deduced in the manner described above.

Figure 10:
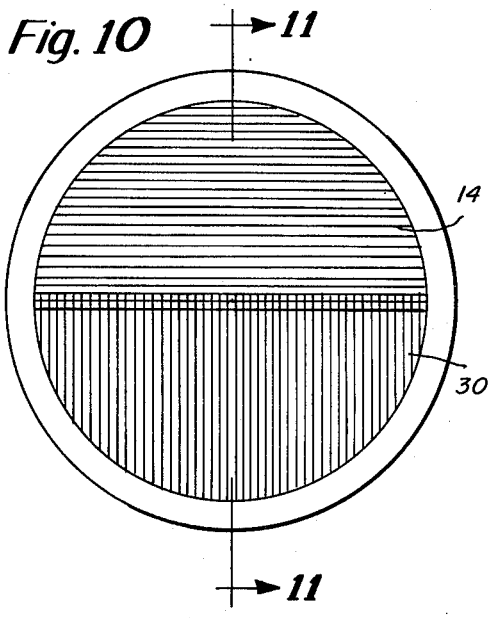
FIG. 10 is a diagrammatic view illustrating the two components of the invention in a position to provide a flood configuration.
Figure 11:
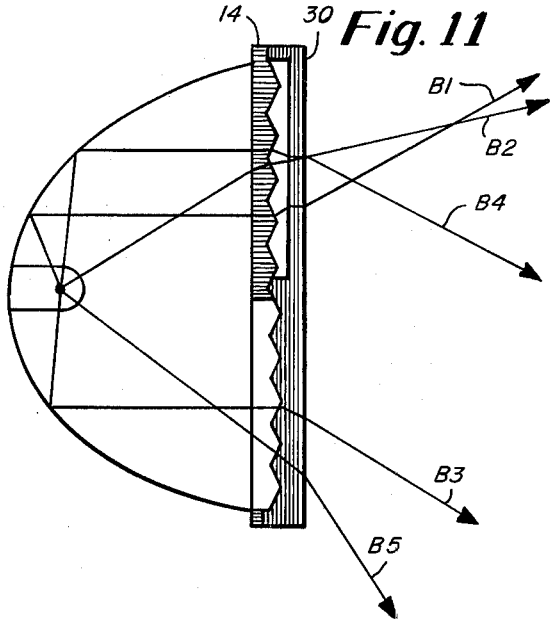
FIG. 11 is a cross section taken on the line 11—11 of FIG. 10 and illustrating diagrammatically by arrows the flood configuration.

When the two components 14 and 30 are moved into a position such as that shown in FIGS. 10 and 11, as may be done by rotating the disk cover component about the housing, there may be achieved a change in direction of reflected light rays to produce a flood configuration.

FIG. 10 illustrates diagrammatically the relationship between the refracting portions, the horizontal cross hatching indicating the refracting portions of the disk component 14 and the vertical cross hatching indicating the refracting portions of disk cover 30.

FIG. 11 illustrates diagrammatically the behavior of the reflected light rays as B1, B2, B3, B4 and B5. Rays B1, B2 and B4 are first refracted with their paths of travel bent by the refracting portions of complnent 14; these rays then pass through the planar portion **30*b* of member 30** to emerge from this component with the path of travel only slightly displaced.

Light rays B3 and B5 pass through opening **14*a* of 14 without change, and are refracted by the refracting portions of member 30** to emerge with their paths of travel bent as indicated.

An important feature of the invention is to provide in the dual light transmitting device the ability to gradually expand the configuration of light from a spot configuration to a flood configuration by progressively illuminating certain areas peripheral to the spot and by increasing the breadth of such until the spot is totally surrounded by light. As this expansion of illuminated areas is carried out, it will be understood that the intensity of the spot will be decreased.

Figure 12:
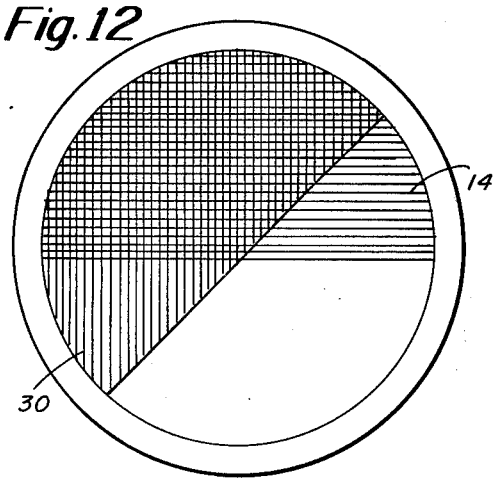
FIGS. 12, 13, 14 and 15 are additional diagrammatic views illustrating the disk component and the disk cover component in progressive stages of forming a flood configuration.

FIG. 12 illustrates diagrammatically the relationship of the refracting parts of disk 14 and disk cover 30 when disk cover 30 has been rotated into a partial flood position. Horizontal cross hatching illustrates the position refracting elements of disk 14 and vertical cross hatching indicates the position of refraction portions of disk cover 30.

Figure 13:
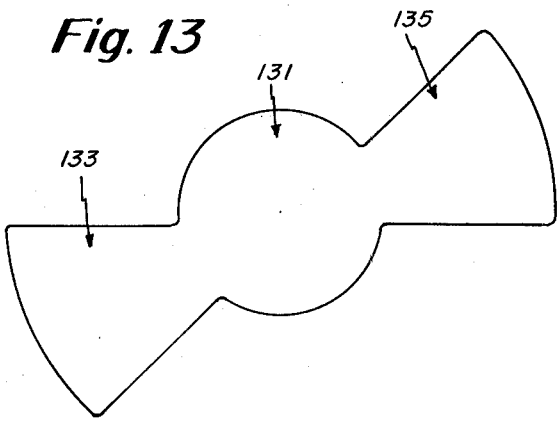

It can be seen by an examination of this figure that refracting portions are partially mated. Refraction will occur at the non-mating parts in a manner similar to that illustrated in FIG. 11. Light rays will be emitted unchanged by mated portions in a manner similar to that illustrated in FIG. 13. FIG. 13 also illustrates the configuration of light emitted from the liminaire as follows; The area designated by arrow 131 is produced by the mated portions. Illuminated areas, as indicated by the arrows 133 and 135, are produced by the refracting effects of nonmated portions.

It is evident from examination of FIG. 13 that the illuminated peripheral areas may be of predetermined orientation, dependent upon the orientation of the fixed disk component of the system.

Figure 14:
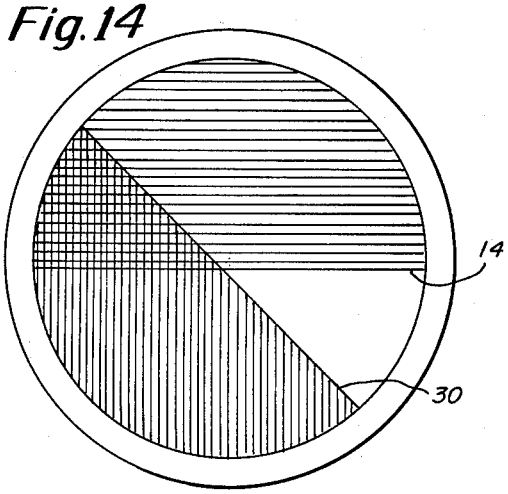
Figure 15:
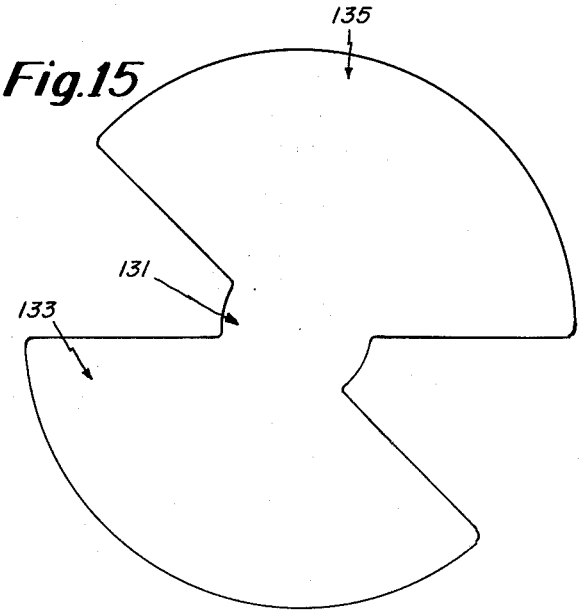

FIGS. 14 and 15 are similar to FIGS. 12 and 13, respectively, except that the disk cover component 30 has been rotated still further toward a flood position. As can be seen from an inspection of FIG. 15, illuminated areas peripheral to the spot are indicated by the arrows 133 and 135 and the breadth of these areas has been broadened. The spot position is indicated by the arrow 131 as earlier discussed.

It is obvious that the truncated arcuate refracting lens portions may extend in a plurality of equal sectors, rather than the substantially semi arcuate configuration described above.

Although the liminaire device shown and disclosed is constructed with a screw base, it should be understood that such a luminaire arrangement could be provided with a cord, a battery and means for attaching the luminaire to a miner's cap lamp. It should also be understood that the invention device may be designed for attachment to virtually any existing type of luminaire where a circular aperture is provided for emission of light and a parabolic reflecting surface is utilized.

I claim:

1. Luminaire apparatus for controlling reflected radiant energy to produce a spot to flood configuration, said apparatus comprising a housing body having a reflector surface, lamp means mounted in the reflector body at the focal point of the reflector surface, a dual light transmitting unit supported at an outer side of the housing body, said dual light transmitting unit including a light transmitting disk component of circular shap fixed to the housing and a disk cover component mounted for rotative movement about the central axis of the housing and in constantly maintained relationship against the disk component, said light transmitting disk component being formed throughout more than 180° of its extent with truncated arcuate mating portions which present V-shaped surfaces whose crests occur in concentrically spaced apart relation to one another, said rotatably mounted disk cover component formed at an inner side thereof throughout more than 180° of its extent with truncated arcuate mating portions, said mating portions having V-shaped surfaces which are complimentary to the V-shaped surfaces of the disk component and which are rotatable into and out of full engagement with the V-shaped surfaces of the disk component to provide for at least some portions of the V-shaped surfaces being in constantly maintained relationship against the disk component.

2. The invention of claim 1 in which the said V-shaped mating surfaces of the disk component and disk cover component are characterized by angles of inclination which control transmission of said radiant energy such that a spot configuration is produced when the surfaces of each component are located in fully mated relationship to one another, and portions of said V-shaped surfaces, when rotated out of engagement with one another, being operable to transmit the said radiant energy in a diffused configuration.

3. The invention of claim 2 in which the said angles of inclination of the mating surfaces lie within a range of from about 20° to 30°.

4. The invention of claim 1 in which the V-shaped surfaces of the disk component terminate to define an opening extending throughout an arc of less than 180° and the truncated arcuate mating portions of the disk cover are movable into a position of register with the said opening to produce a flood configuration.

5. The invention of claim 1 in which the V-shaped surfaces of the disk component terminate to define an opening extending throughout an arc of less than 180° and said truncated mating portions of the disk component having end walls which lie in a common plane parallel to the central axis of the disk component and said disk cover component having a planar light transmitting portion substantially semi-circular in space and said disk cover being movable into a position to register the planar light transmitting portion with the opening in the disk component to provide a spot configuration.

6. The invention of claim 1 in which the V-shaped surfaces of the disk component terminate to define an opening extending throughout of less than 180° and said disk cover component having a planar light transmitting portion substantially semi-circular in shape, said disk cover being movable into a position in which its planar light transmitting portion is in register with the said semi-circular opening in the disk component to provide a spot configuration of refracted light.

7. The invention of claim 1 in which the V-shaped surfaces of the disk component terminate to define an opening extending throughout of less than 180° and said truncated mating portions of the disk component having end walls which lie in a common plane parallel to the central axis of the disk component and said disk cover component having a planar light transmitting portion substantially semi-circular in shape and said disk cover being movable into a position to register the planar light transmitting portions with openings in the disk component to provide a spot configuration, and said end walls being defined by cleaning edges which are engageable with the V-shaped surfaces of the disk component.

8. The invention of claim 1 in which the mating portions of the disk component and the disk cover component are movable into positions of partially mated relationship to provide controlled areas of diffusion peripheral to a spot configuration at opposite sides thereof.

* * * * *